US006981435B2

(12) United States Patent
Hsien

(10) Patent No.: US 6,981,435 B2
(45) Date of Patent: Jan. 3, 2006

(54) RATCHET WRENCH HAVING A SEALING STRUCTURE

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 35 days.

(21) Appl. No.: 10/436,417

(22) Filed: May 8, 2003

(65) Prior Publication Data

US 2004/0221687 A1 Nov. 11, 2004

(51) Int. Cl.
*B25B 13/46* (2006.01)

(52) U.S. Cl. ..... 81/63.2; 81/60; 81/61

(58) Field of Classification Search ..... 81/63.2, 81/60, 61, 62, 63, 63.1
See application file for complete search history.

(56) References Cited

U.S. PATENT DOCUMENTS 3,713,356 A * 1/1973 Knudsen ..... 81/177.85
4,634,097 A * 1/1987 Hubertson ..... 251/173
4,645,362 A * 2/1987 Orte ..... 384/485
5,848,561 A * 12/1998 Hsieh ..... 81/59.1

* cited by examiner

*Primary Examiner*—Joseph J Hail, III
*Assistant Examiner*—Alvin J. Grant

(57) ABSTRACT

A ratchet wrench includes a wrench body having a drive head formed with a receiving recess, a ratchet wheel rotatably mounted in the receiving recess of the drive head, a positioning member secured in the receiving recess of the drive head and secured on the ratchet wheel to retain the ratchet wheel in the receiving recess of the drive head, and an oil seal secured in the receiving recess of the drive head and enclosed around the positioning member. Thus, the positioning member is a C-shaped snap that can abut and press the oil seal so as to position the oil seal actually, so that the oil seal has a better positioning effect.

2 Claims, 6 Drawing Sheets

RATCHET WRENCH HAVING A SEALING STRUCTURE

BACKGROUND OF THE INVENTION

1. Field of the Invention

The present invention relates to a ratchet wrench, and more particularly to a ratchet wrench having a sealing structure.

2. Description of the Related Art

A conventional ratchet wrench has an oil seal to prevent the dust or particles from entering the inner space of the ratchet wrench so as to provide a dustproof effect. However, the oil seal cannot be positioned rigidly and stably, thereby decreasing the sealing effect. In addition, the oil seal is easily worn out during a long-term utilization.

SUMMARY OF THE INVENTION

The primary objective of the present invention is to provide a ratchet wrench having a sealing structure that can be positioned rigidly and stably.

Another objective of the present invention is to provide a ratchet wrench, wherein the C-shaped snap can abut and press the oil seal to position the oil seal accurately, so that the oil seal has a better positioning effect.

A further objective of the present invention is to provide a ratchet wrench, wherein the oil seal can receive and entirely cover the C-shaped snap to prevent the C-shaped snap from being worn out.

In accordance with the present invention, there is provided a ratchet wrench, comprising:

a wrench body having a drive head formed with a receiving recess;

a ratchet wheel rotatably mounted in the receiving recess of the drive head;

a positioning member secured in the receiving recess of the drive head and secured on the ratchet wheel to retain the ratchet wheel in the receiving recess of the drive head; and an oil seal secured in the receiving recess of the drive head and enclosed around the positioning member.

In accordance with the present invention, there is also provided a ratchet wrench, comprising:

a wrench body having a drive head formed with a receiving recess;

a direction control switch rotatably mounted in the receiving recess of the drive head;

a positioning member secured in the receiving recess of the drive head and secured on the direction control switch to retain the direction control switch in the receiving recess of the drive head; and an oil seal secured in the receiving recess of the drive head and enclosed around the direction control switch.

Further benefits and advantages of the present invention will become apparent after a careful reading of the detailed description with appropriate reference to the accompanying drawings.

DETAILED DESCRIPTION OF THE INVENTION

Figure 1:
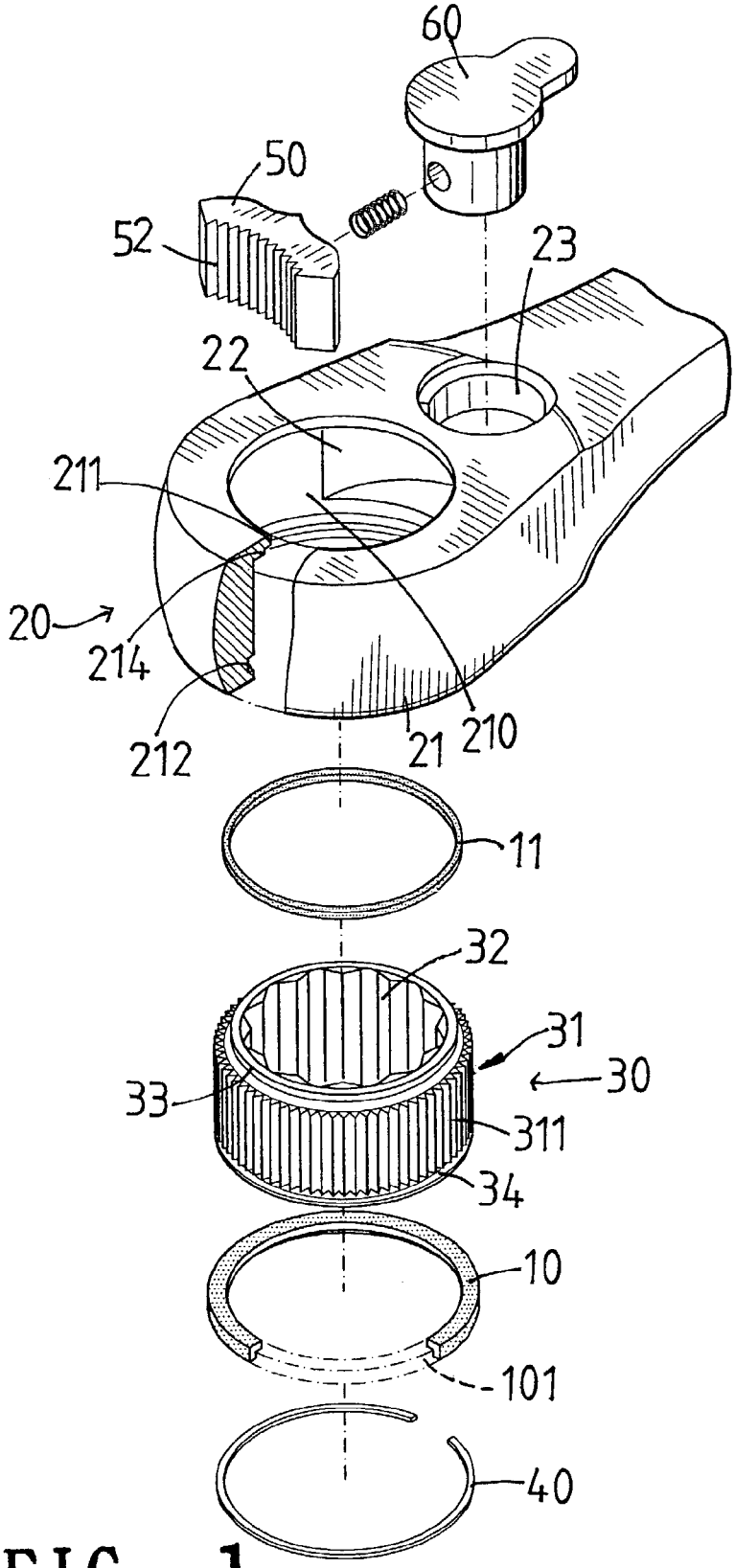
FIG. 1 is an exploded perspective view of a ratchet wrench in accordance with the preferred embodiment of the present invention.
Figure 2:
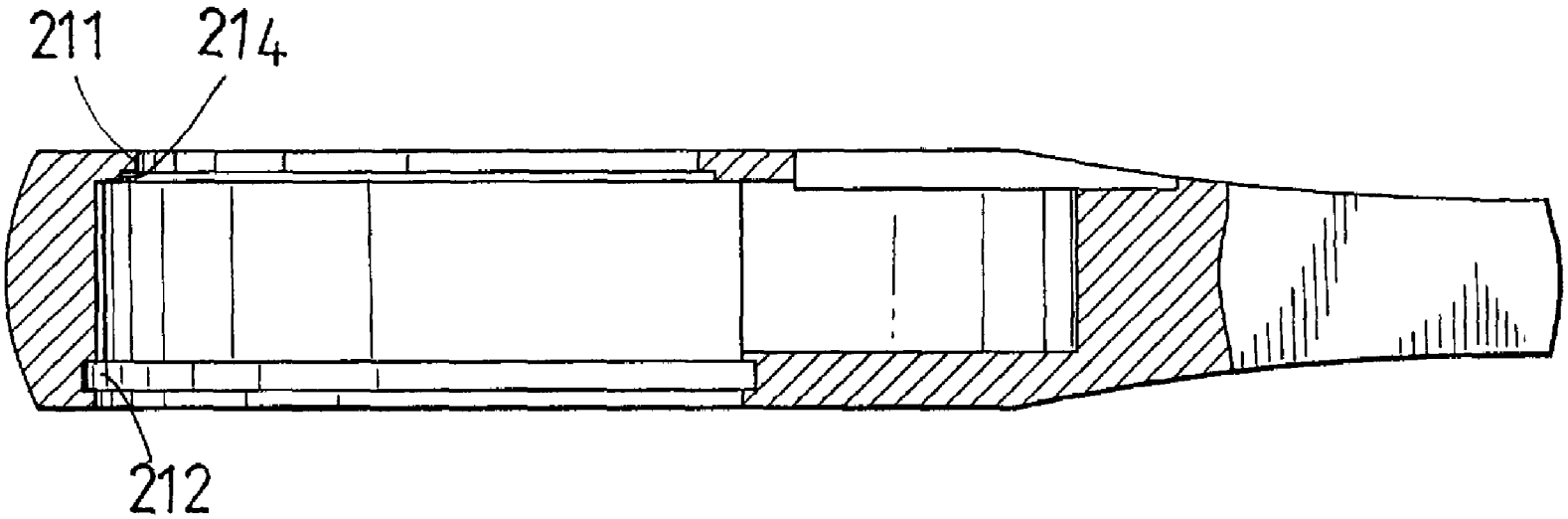
FIG. 2 is a partially side plan cross-sectional assembly view of the ratchet wrench as shown in FIG. 1.
Figure 3:
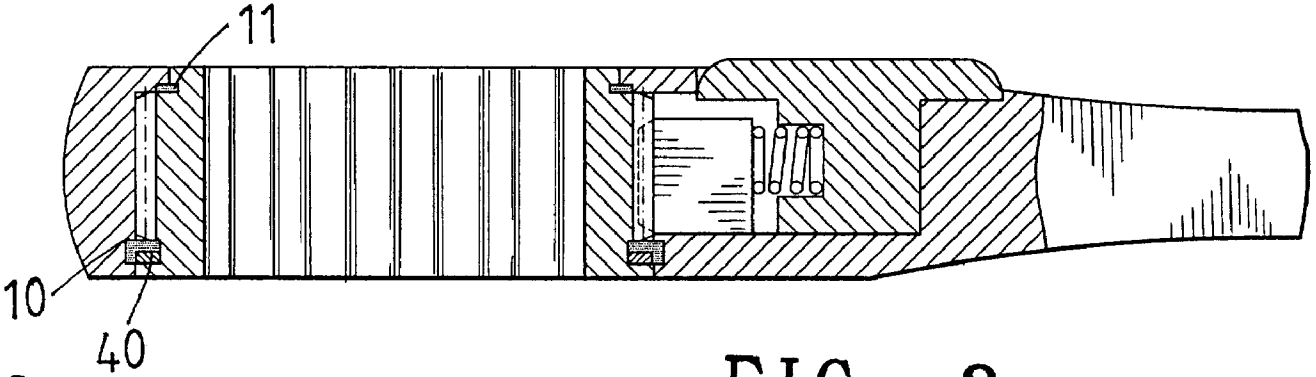
FIG. 3 is a side plan cross-sectional assembly view of the ratchet wrench as shown in FIG. 1.
Figure 3A:
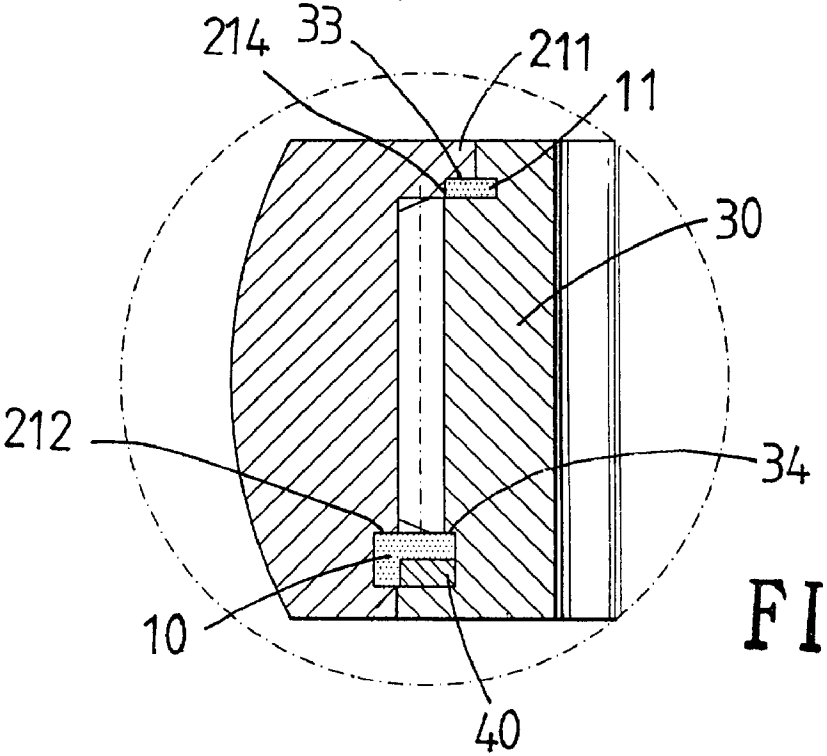
FIG. 3A is a partially enlarged view of the ratchet wrench as shown in FIG. 3.

Referring to the drawings and initially to FIGS. 1–3 and 3A, a ratchet wrench in accordance with the preferred embodiment of the present invention comprises a wrench body 20, a ratchet wheel 30, a pawl member 50, and a direction control switch 60.

The wrench body 20 has an end formed with a drive head 21. The drive head 21 has a first portion formed with a first receiving recess 210, a mediate portion formed with a second receiving recess 22 communicating with the first receiving recess 210, and a second portion formed with a third receiving recess 23 communicating with the second receiving recess 22. The first receiving recess 210 has an upper end formed with a protruding shoulder 211 and a lower end formed with a locking groove 212. The protruding shoulder 211 has a bottom formed with a concave annular groove 214.

The ratchet wheel 30 is rotatably mounted in the first receiving recess 210 of the drive head 21. The ratchet wheel 30 has an inner wall formed with a polygonal driving portion 32 for driving a workpiece (not shown), such as a nut or the like. The ratchet wheel 30 has an outer wall 31 formed with a plurality of ratchet teeth 311.

The outer wall 31 of the ratchet wheel 30 has a first end formed with an annular locking recess 33 aligning with the annular groove 214 of the protruding shoulder 211 of the drive head 21. The locking recess 33 has a diameter smaller than that of the outer wall 31 of the ratchet wheel 30. The ratchet wrench further comprises an oil seal 11 secured in the locking recess 33 of the ratchet wheel 30 and received in the annular groove 214 of the protruding shoulder 211 of the drive head 21 to seal the inner space of the ratchet wheel 30. The oil seal 11 is rested on the bottom of the protruding shoulder 211 of the drive head 21.

The outer wall 31 of the ratchet wheel 30 has a second end formed with a concave portion 34. The ratchet wrench further comprises a positioning member 40 (such as a C-shaped snap) secured in the locking groove 212 of the drive head 21 and the concave portion 34 of the ratchet wheel 30 to retain the ratchet wheel 30 in the first receiving recess 210 of the drive head 21.

The ratchet wrench further comprises an oil seal 10 secured in the locking groove 212 of the drive head 21 and the concave portion 34 of the ratchet wheel 30 and is enclosed around the positioning member 40. Preferably, the oil seal 10 has a substantially inverted L-shaped cross-section. Preferably, the oil seal 10 is formed with a receiving space 101 to receive and locally cover the positioning member 40.

The pawl member 50 is pivotally mounted in the second receiving recess 22 of the drive head 21 and has a first side formed with a plurality of engaging teeth 52 meshing with the ratchet teeth 311 of the ratchet wheel 30.

The direction control switch 60 is rotatably mounted in the third receiving recess 23 of the drive head 21 and is rested on a second side of the pawl member 50 to control a driving direction of the pawl member 50.

In assembly, the positioning member 40 is a C-shaped snap, so that the positioning member 40 has an outward expanded elastic force during the mounting process so as to abut and press the oil seal 10, so that the oil seal 10 has a better positioning effect. In addition, the pressing force applied by the positioning member 40 on the oil seal 10 is limited by the wall of the locking groove 212 of the drive head 21 and the wall of the concave portion 34 of the ratchet wheel 30, so that the positioning member 40 produces an upward pressing force to press the oil seal 11, so that the oil seal 11 has a better positioning effect.

Figure 4:
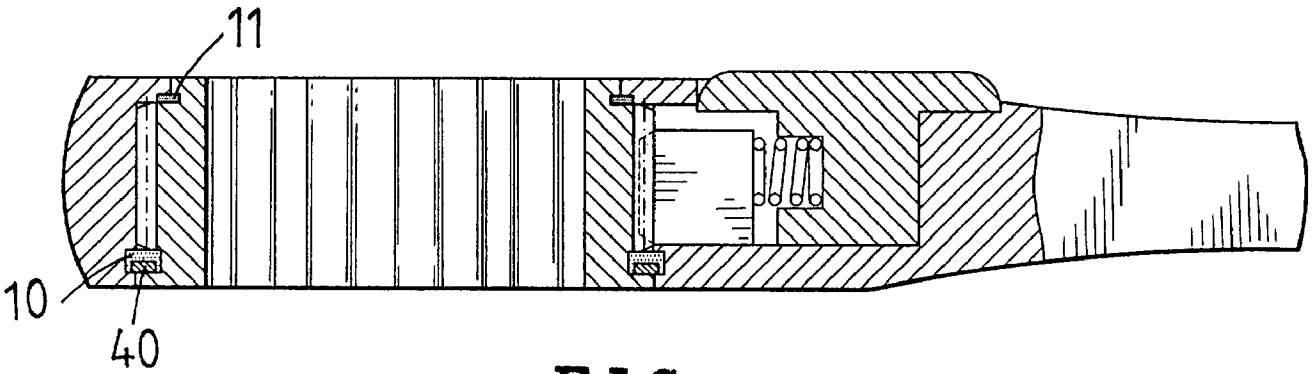
FIG. 4 is a side plan cross-sectional assembly view of the ratchet wrench in accordance with another embodiment of the present invention.
Figure 6:
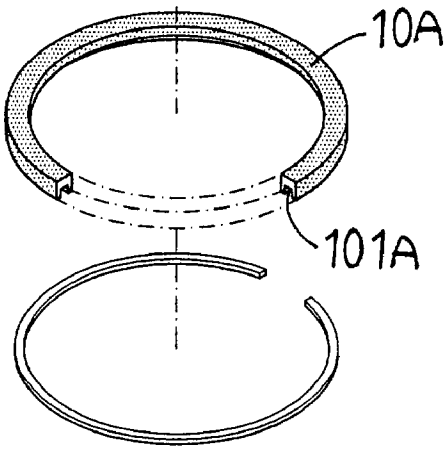
FIG. 6 is a partially exploded perspective view of the ratchet wrench as shown in FIG. 4.
Figure 5:
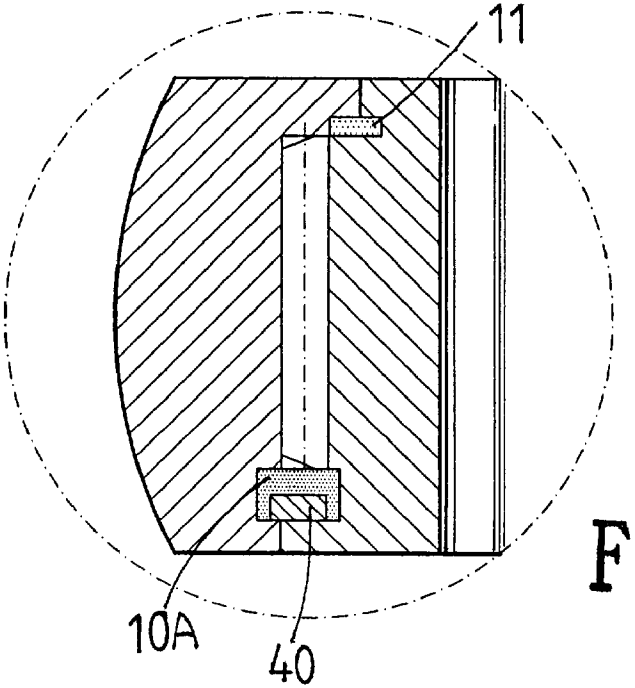
FIG. 5 is a partially enlarged view of the ratchet wrench as shown in FIG. 4.

Referring to FIGS. 4–6, the ratchet wrench in accordance with another embodiment of the present invention is shown, wherein the oil seal 10A has a substantially inverted U-shaped cross-section and is formed with a receiving space 101A to receive and entirely cover the positioning member 40.

Figure 7:
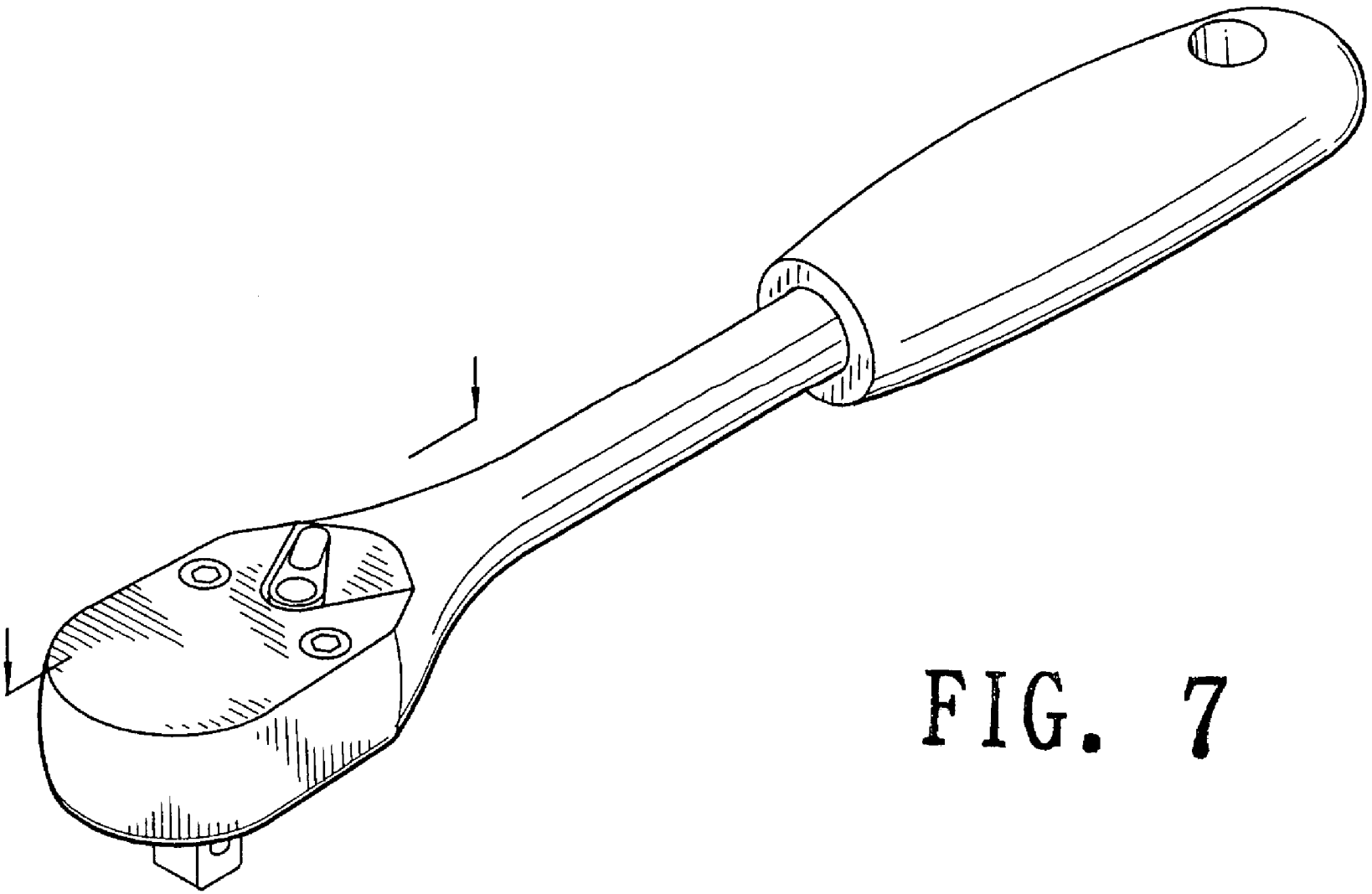
FIG. 7 is a perspective assembly view of the ratchet wrench in accordance with another embodiment of the present invention.
Figure 8:
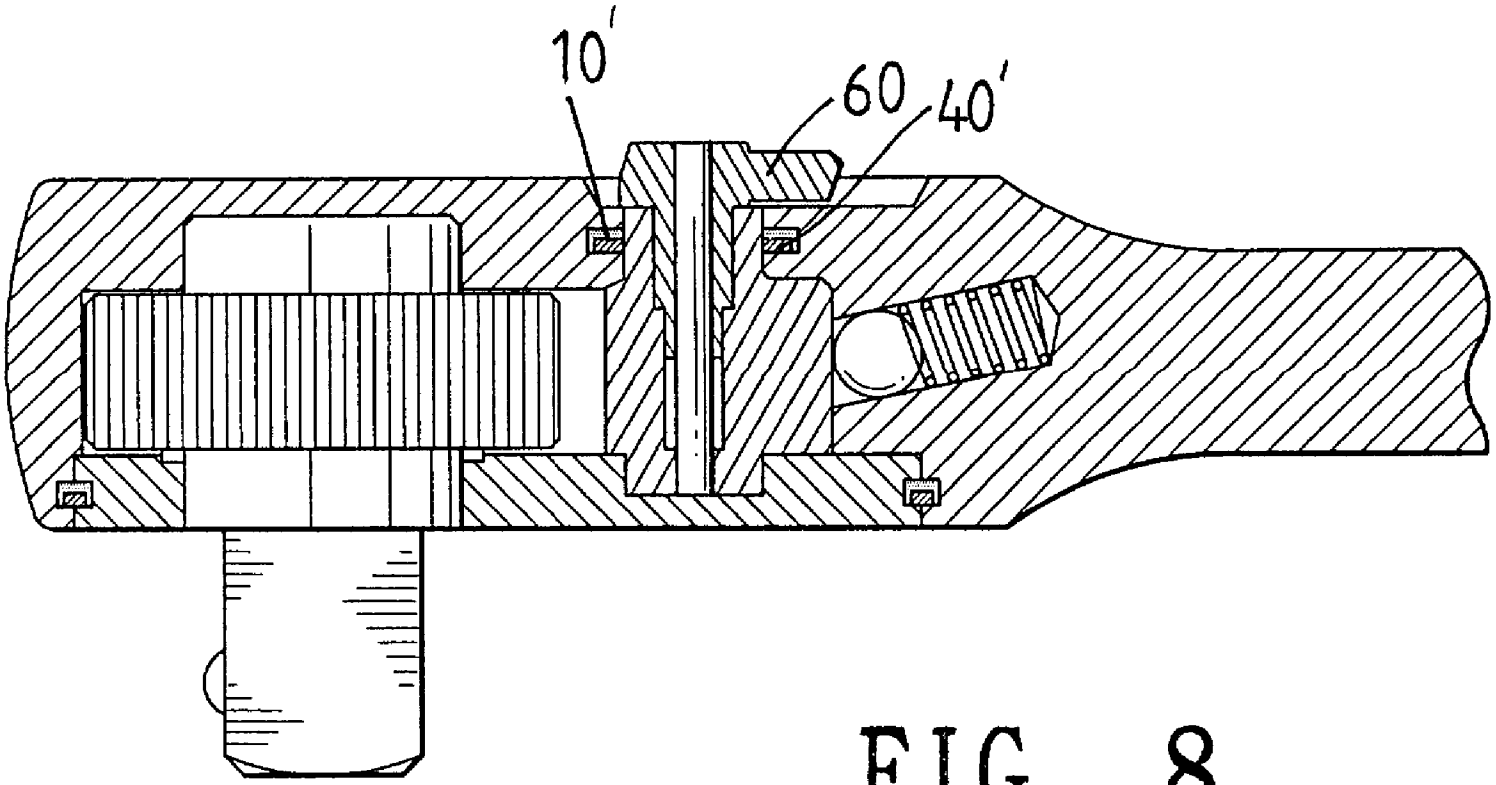
FIG. 8 is a side plan cross-sectional view of the ratchet wrench as shown in FIG. 7.

Referring to FIGS. 7 and 8, the ratchet wrench in accordance with another embodiment of the present invention is shown, wherein the direction control switch 60 is retained by the positioning member 40' and the oil seal 10'.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising:

a wrench body having a drive head formed with a receiving recess;

a ratchet wheel rotatably mounted in the receiving recess of the drive head;

a positioning member secured in the receiving recess of the drive head and secured on the ratchet wheel to retain the ratchet wheel in the receiving recess of the drive head; and an oil seal secured in the receiving recess of the drive head and enclosed around the positioning member; wherein the positioning member is a C shape snap;

the oil seal having a substantially L-shape cross-section;

wherein the receiving recess of the drive head has an end formed with a protruding shoulder having a bottom formed with an annular groove, the ratchet wheel has an outer wall having an end formed with an annular locking recess aligning with the annular groove of the protruding shoulder of the drive head, and the ratchet wrench further comprises a second oil seal secured in the locking recess of the ratchet wheel and received in the annular groove of the protruding shoulder of the drive head to seal the inner space of the ratchet wheel.

2. The ratchet wrench in accordance with claim 1, wherein the second oil seal is rested on the bottom of the protruding shoulder of the drive head.

* * * * *